US006773294B1

(12) United States Patent
Urban et al.

(10) Patent No.: US 6,773,294 B1
(45) Date of Patent: Aug. 10, 2004

(54) ELECTRICAL CONNECTOR AND NETWORK INTERFACE MODULE

(75) Inventors: Blake R. Urban, Lenior, NC (US); Isaac D. M. White, Orlando, FL (US); James E. Dickens, Ocoee, FL (US); Kevin Forsberg, Orlando, FL (US); Charles Sawyer, Orlando, FL (US)

(73) Assignee: Bellsouth Intellectual Property Corporation, Wilmington, DE (US)

( * ) Notice: Subject to any disclaimer, the term of this patent is extended or adjusted under 35 U.S.C. 154(b) by 0 days.

(21) Appl. No.: 10/351,617

(22) Filed: Jan. 24, 2003

(51) Int. Cl.[7] ..... H01R 11/20
(52) U.S. Cl. ..... 439/409; 439/425
(58) Field of Search ..... 439/409, 425, 439/417, 188

(56) References Cited

U.S. PATENT DOCUMENTS

| | | | |
|---|---|---|---|
| 4,701,138 | A | 10/1987 | Key |
| 4,729,738 | A | 3/1988 | Heng |
| 4,793,823 | A | 12/1988 | Cozzens |
| 4,979,209 | A | 12/1990 | Collins |
| 4,995,829 | A | 2/1991 | Geib |
| 5,291,553 | A | 3/1994 | Smith |
| 5,450,469 | A | 9/1995 | Pamart |
| 5,479,505 | A | 12/1995 | Butler |
| 5,667,402 | A | 9/1997 | Denovich |
| 5,901,220 | A | 5/1999 | Garver |
| 6,238,250 | B1 | 5/2001 | Stohr |
| 6,246,749 | B1 | 6/2001 | Garver |
| 6,254,421 | B1 | 7/2001 | Denovich |
| 6,324,283 | B1 | 11/2001 | Garver et al. |
| 2002/0155745 | A1 | 10/2002 | Vo |

*Primary Examiner*—Tho D. Ta
(74) *Attorney, Agent, or Firm*—Walters & Zimmerman; Geoff Sutcliffe; Todd Mitchem

(57) ABSTRACT

A connector is disclosed for electrically connecting a conductor to a terminal. The connector has a body and an electrically conductive member. The body has a passage for positioning the conductor therein. The passage has an aperture to an outer surface of the body. The electrically conductive member has a first portion and a second portion. The first portion extends through the aperture for crimping the conductor in the passage, and the second portion is for electrically connecting to the terminal. The electrically conductive member moves to disconnect the second portion from the terminal while still crimping the conductor in the passage.

12 Claims, 9 Drawing Sheets

ELECTRICAL CONNECTOR AND NETWORK INTERFACE MODULE

BACKGROUND OF THE INVENTION

1. Field of the Invention

This invention generally relates to electrical connectors and, more particularly, to an electrical connector that crimps a conductor.

2. Description of the Related Art

A Network Interface Device provides a demarcation between a telecommunications or cable network and a customer's internal wiring. These Network Interface Devices have a customer side and a service provider side. The service provider's side of the Network Interface Device is usually secured to prevent the customer from accessing the network side. The customer's side of the Network Interface Device usually includes one or more network interface network interface modules that connect the customer's wiring to the network. These network interface network interface modules often include a modular jack (such as an RJ-11 receptacle), and this modular jack is used to determine whether a fault is the customer's responsibility or the service provider's responsibility. An electrically open condition, or an electrically shorted condition, are some examples of faults that may indicate a problem with the customer's internal wiring. A technician, for example, may take voltage and current measurements from the modular jack, and an open or short condition can indicate the source of the fault. The customer, too, can insert a mating modular telephone plug and, if a dial tone is heard on a telephone, the fault must lie within the customer's internal wiring.

When a person determines the responsibility for a fault, the customer's inside wiring is often isolated. That is, wiring inside the customer's premises is electrically disconnected, or isolated, from the network. A network interface network interface module is disconnected from the network, thus isolating any lines, cables, or other conductors connected from that network interface module to the network. The conductors are tested to determine the location of the fault. If the fault is not located within those conductors, the conductors must be reconnected to the network interface network interface module.

Reconnecting the conductors, however, is time-consuming and wasteful. Because determining the location of a fault is often a trial-and-error process, many conductors are removed and then reconnected before the fault is located. Each time a conductor is removed and then reconnected, the end of the conductor must be cut, stripped, and tested. When a customer has multiple conductors connected to a network interface network interface module, removing and reconnecting each conductor is a time-consuming task. As each conductor is also cut and stripped for reconnection, the conductors get shorter and shorter. The trial-and-error cutting and stripping process shortens the conductors. As the conductors get shorter, grasping and handling the conductors becomes more difficult. The trial-and-error cutting and stripping process also wastes good conductors, and eventually requires splicing a replacement conductor. There is, accordingly, a need in the art for a connector that allows a person to locate faults without wasting conductors, a need for a connector that isolates a conductor without having to cut and strip for reconnection, and a need for a connector that is faster to reconnect.

BRIEF SUMMARY OF THE INVENTION

The aforementioned problems, and other problems, are reduced by an improved connector. This connector is used to electrically connect a conductor to a terminal. The term "conductor" describes the wires, cables, coaxial cables, fiber optic cables, and other mediums that carry, or "conduct," electrons from one location to another location. This improved connector has a two-stage operation. A first stage disconnects the connector from the terminal, yet the conductor is retained in the connector. When the connector is moved to a second stage, the connector releases the conductor. While this connector has universal applications, this invention is especially useful in a telecommunications network or in a cable network. When a technician must test a customer's wiring, the connector of this invention allows the technician to quickly isolate the customer's wiring from the network without removing conductors from the connector. The technician is then able to quickly determine whether a fault (e.g., an open or shorted condition) lies within the customer's wiring or within the network. If no fault is located, the technician can close the connector and quickly re-establish electrical communication with the network, all without removing the conductors and stripping new ends. The connector of this invention thus allows the technician to more quickly diagnose and resolve customer problems. This invention also saves money by permitting the technician to complete more repairs per week.

One embodiment of this invention describes a connector for electrically connecting a conductor to a terminal. The connector has a body and an electrically conductive member. The body has a passage for positioning the conductor therein. The passage has an aperture to an outer surface of the body. The electrically conductive member has a first portion and a second portion. The first portion extends through the aperture for crimping the conductor in the passage, and the second portion is for electrically connecting to the terminal. The electrically conductive member moves to disconnect the second portion from the terminal while still crimping the conductor in the passage.

Another embodiment of this invention describes a network interface module for a Network Interface Device. The network interface module connects a conductor between a customer's premises and a network. The network interface module comprises a base, a cover for the base, a terminal electrically connectable to a connector, and means for electrically disconnecting the conductor from the terminal while retaining the conductor in the connector. This network interface module allows the customer's premises to be isolated and tested while the conductor is retained in the connector.

Still another embodiment of this invention describes a network interface module for a Network Interface Device. The network interface module connects a conductor between a customer's premises and a network. The network interface module comprises a base, a cover for the base, and a terminal electrically connectable to a connector. The connector has a first position for permitting electrical communication between the conductor and the terminal. The connector has a second position for electrically disconnecting the connector from the terminal while retaining the conductor secured to the connector. The connector has a third position for electrically disconnecting the connector from the terminal and for releasing the conductor from the connector. The connector allows the customer's premises to be isolated and tested while still retaining the conductor in the connector.

BRIEF DESCRIPTION OF THE SEVERAL VIEWS OF THE DRAWINGS

These and other features, aspects, and advantages of this invention are better understood when the following Detailed Description of the Invention is read with reference to the accompanying drawings, wherein.

DETAILED DESCRIPTION OF THE INVENTION

Figure 1:
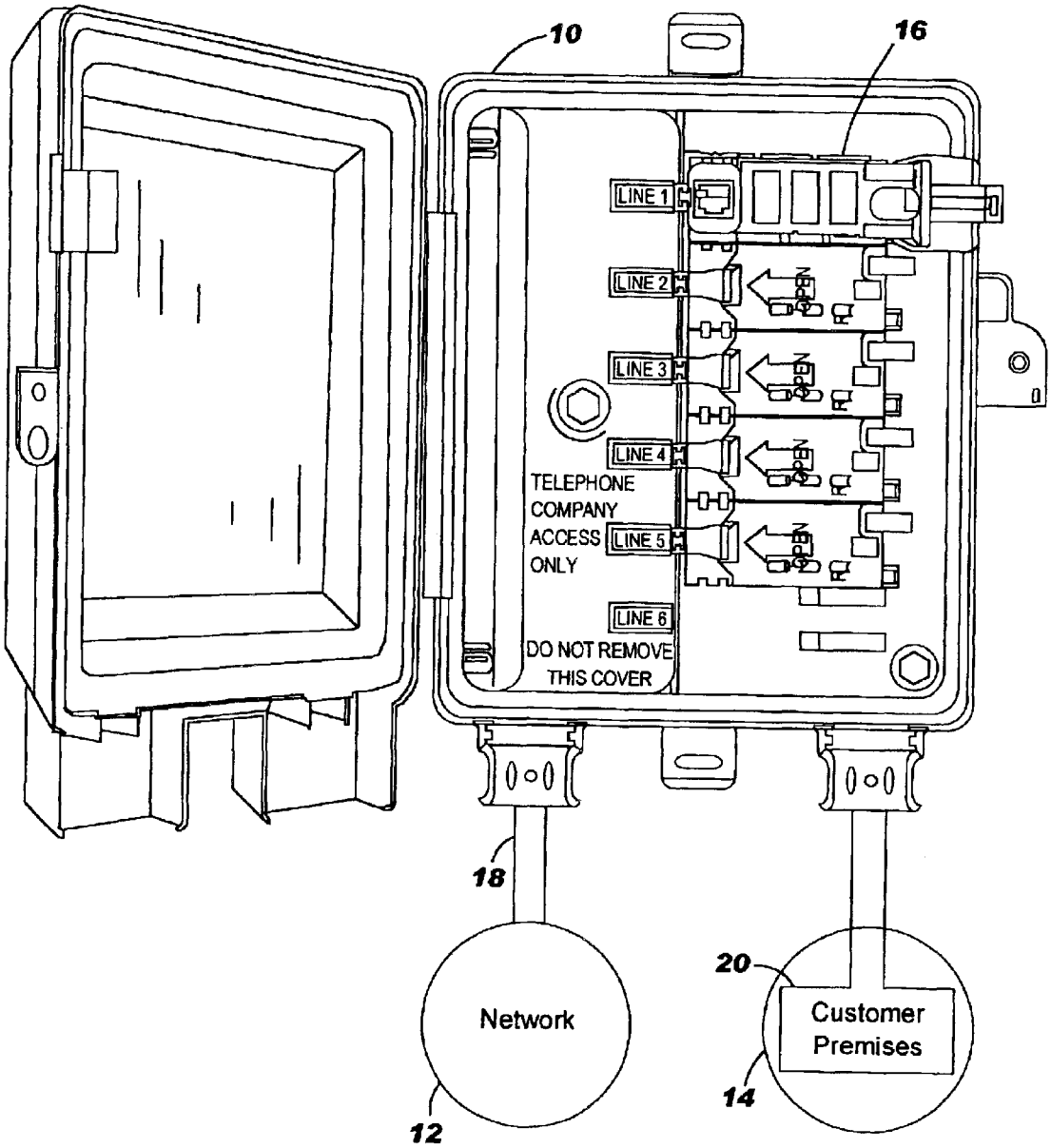
FIG. 1 is a schematic illustrating an operating environment for this invention.

FIG. 1 is a schematic illustrating an operating environment for this invention. FIG. 1 shows a Network Interface Device 10. This Network Interface Device 10 provides an interconnection between network 12 and a customer's premises 14. The Network Interface Device 10 commonly interconnects a telecommunications network with the customer's premises 14, but the Network Interface Device 10 also interconnects a cable network with the customer's premises 14. There are many Network Interface Devices available in the market. Corning Cable Systems, for example, markets many weather-resistant enclosures, such as the NI-2006 Network Interface Device, for both indoor and outdoor installations (Corning Cable Systems LLC, P.O. Box 489, Hickory N.C. 28603, 800.743.2685). Because Network Interface Devices are well-known and widely used, this patent will not describe the Network Interface Device 10 in detail. Suffice it to say the Network Interface Device 10 includes one or more network interface modules 16. The network interface modules 16 provide a demarcation between the conductors 18 of the network 12 and the inside wiring 20 of the customer's premises 14. The network interface module 16 is thus used to segregate responsibility for faults between the customer and the network service provider.

Figure 2:
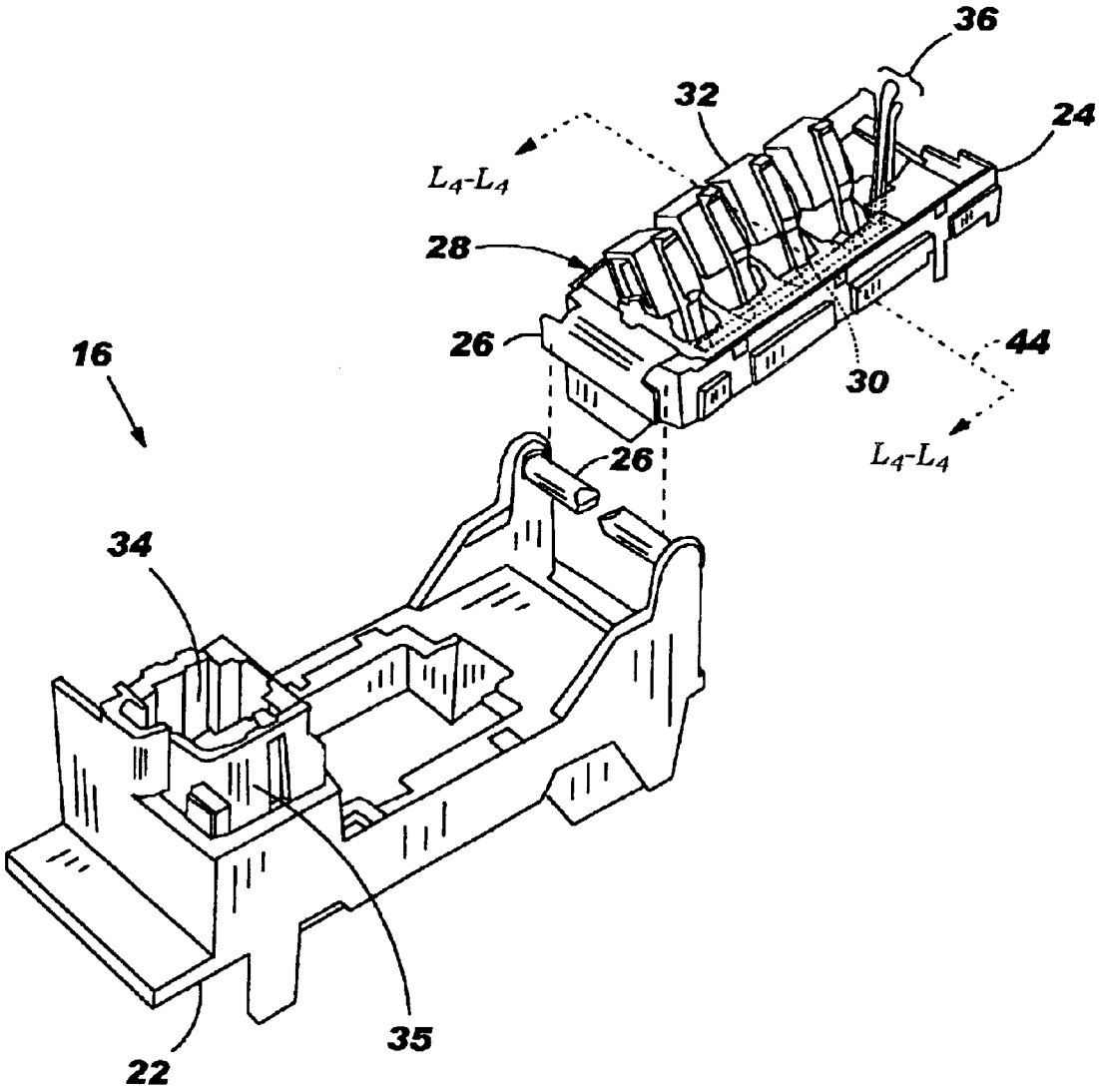
FIG. 2 is a schematic illustrating a network interface module shown in FIG. 1.

FIG. 2 is a schematic illustrating the network interface module 16 shown in FIG. 1. The network interface module 16 shown in FIGS. 1 and 2 is a basic representation of the many designs of network interface modules used in telecommunications and in cable television. The network interface module 16 has a base 22 and a cover 24 for the base 22. A hinge 26 often interconnects the base 22 and the cover 24, thus allowing the cover 24 to pivot about the hinge 26. The base 22 may house telephone circuitry and protection circuitry, the details of which are not pertinent to this invention. The cover 24 then opens and closes to provide access to an interior 28 of the cover 24. Housed within the interior 28 of the cover 24 is a terminal 30 electrically connectable to a connector 32. The terminal 30 electrically communicates with the conductors of the network (shown, respectively, as reference numerals 18 and 12 in FIG. 1). The connector 32, in turn, electrically communicates between the terminal 30 and the inside wiring of the customer's premises (shown, respectively, as reference numerals 20 and 14 in FIG. 1). The network interface module 16 may further comprise a modular jack 34 retained by a bridge portion 35 of the base 22. The modular jack 34 electrically communicates with the conductors of the network and provides a means of locating faults in the customer's inside wiring. The modular jack 34 can be of many designs, but the modular jack 34 is most commonly RJ-11 or RJ-56. FIG. 2 shows the modular jack 34 is connectable to the terminal 30 by a pair of terminal arms 36. The terminal arms 36 outwardly extend from the terminal 30. When the cover 24 pivots and engages the base 22, the terminal arms 36 insert into the modular jack 34. The terminal arms 36 provide electrical communication between the terminal 30 and terminals (not shown) within the modular jack 34. Because the construction and operation of network interface modules is well understood by those of ordinary skill in the art, further details are omitted unless necessary for disclosure of this invention.

Figure 3:
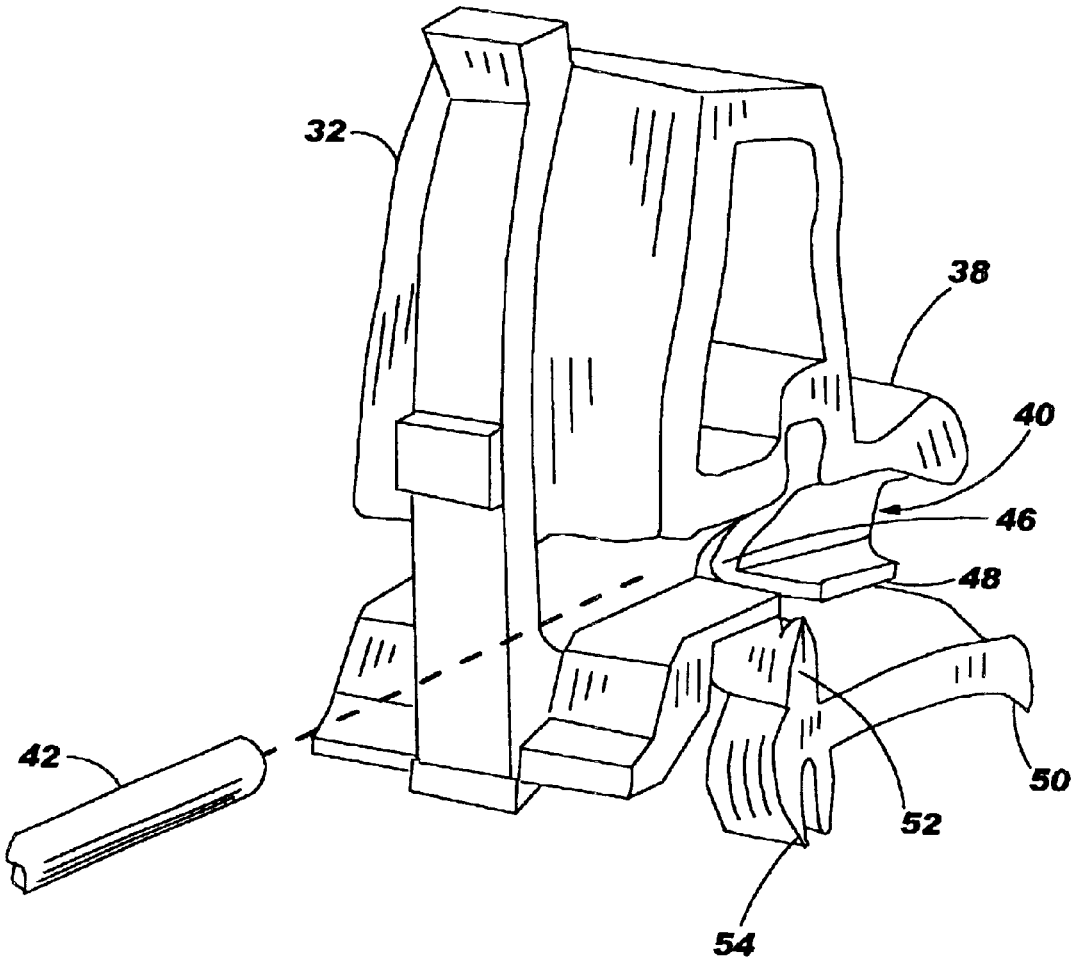
FIGS. 3–6 are schematics showing a connector shown in FIG. 2.
Figure 4:
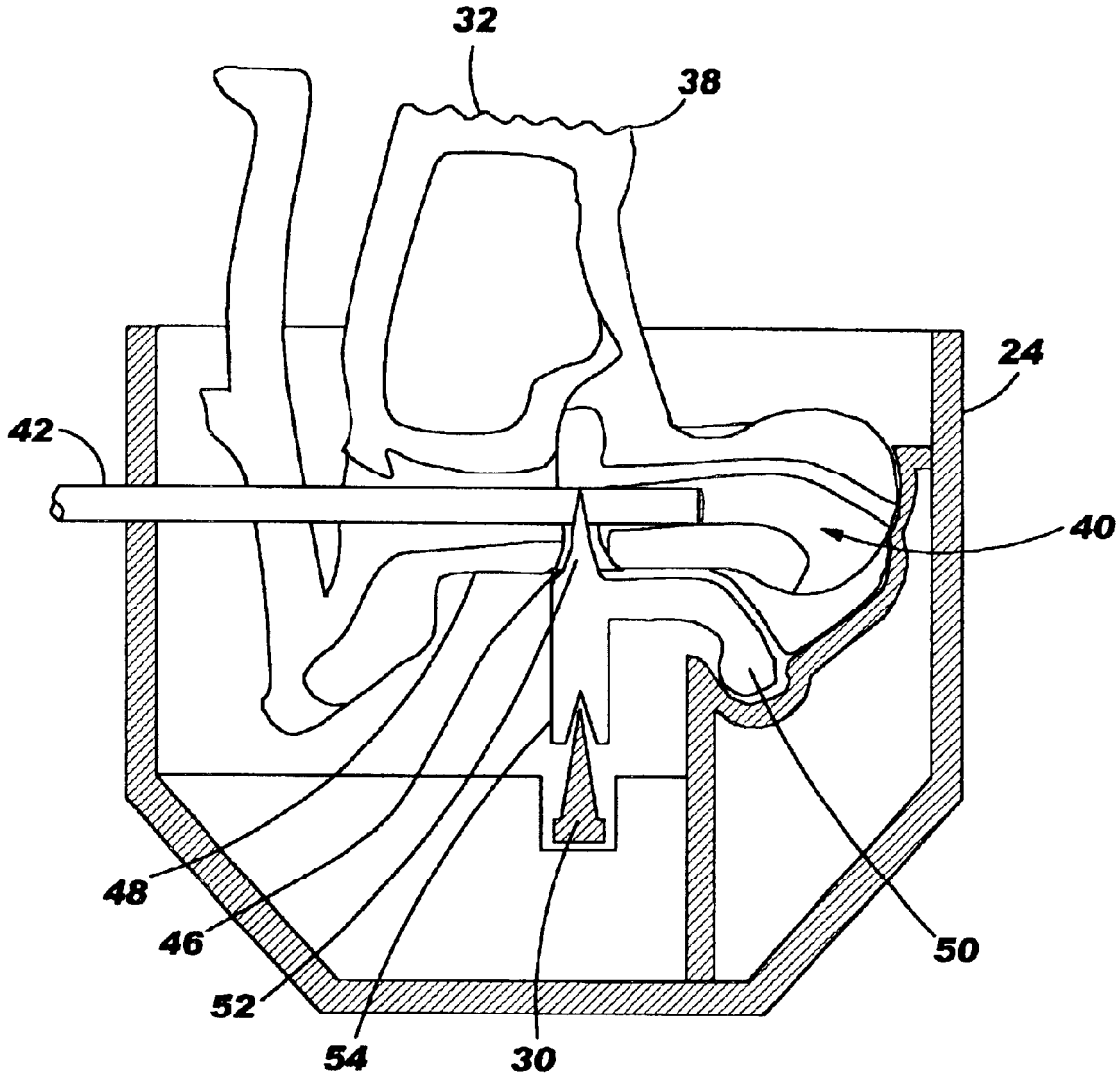
Figure 5:
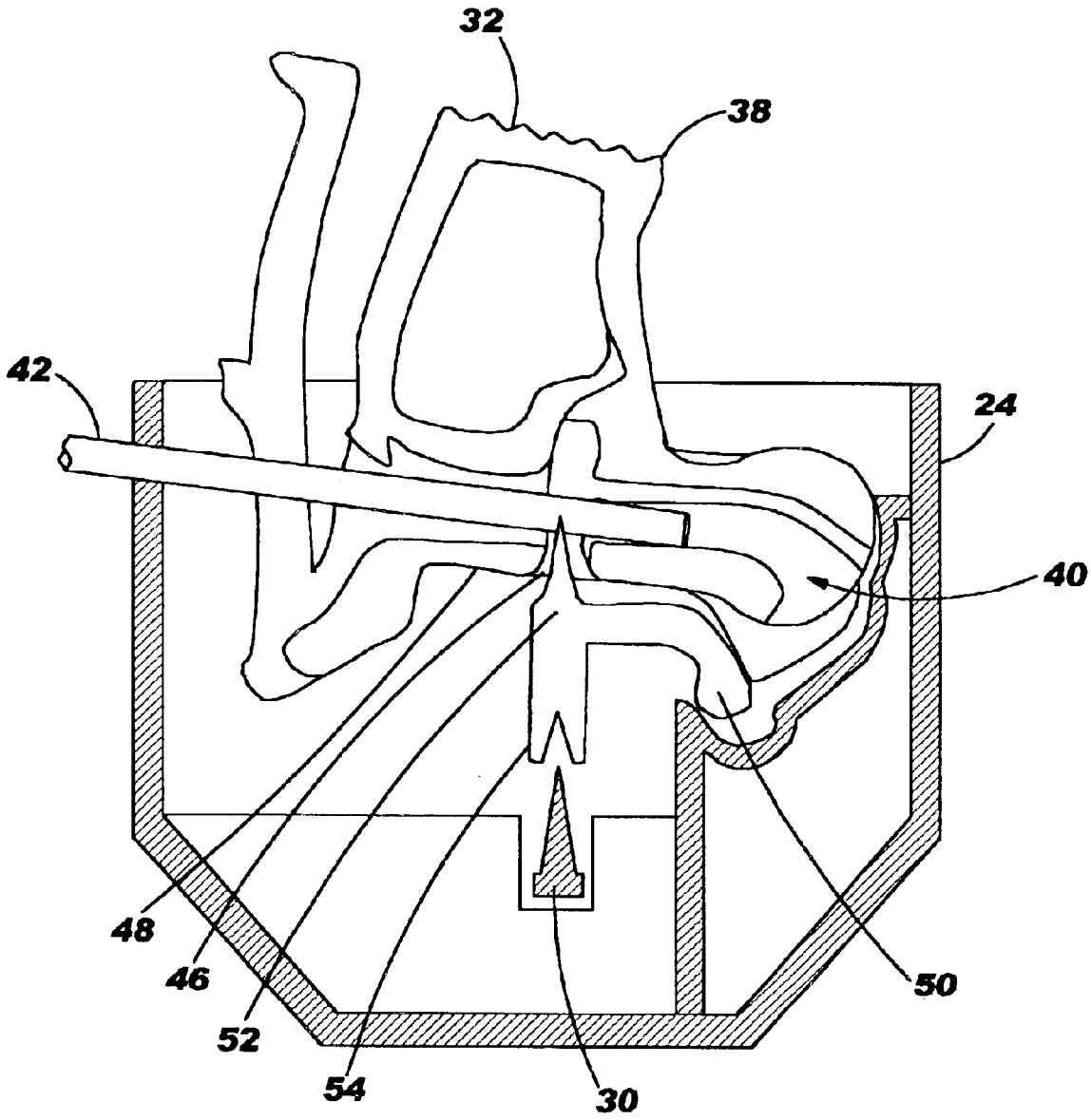
Figure 6:
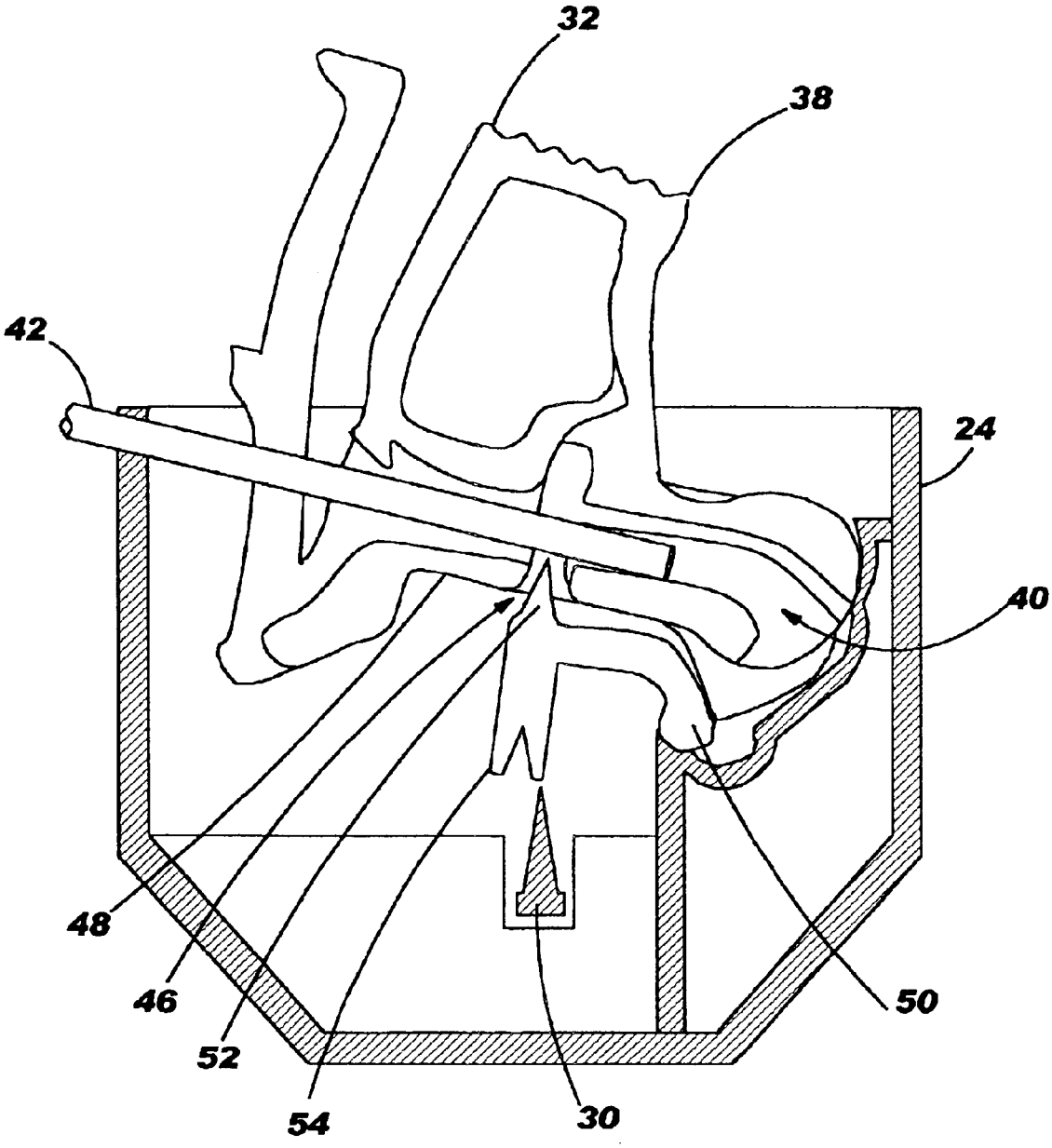

FIGS. 3–6 are schematics showing the connector 32 shown in FIG. 2. FIGS. 3–6 are enlarged for clarity. FIG. 3 is an isometric view of the connector 32, while FIGS. 4–6 are sectional side views of the cover 24 taken along line $L_4$—$L_4$ (shown as reference numeral 44) of FIG. 2. FIGS. 4–6 also show the connector 32 housed in the cover 24. The connector 32 has a body 38 having a passage 40 for positioning a conductor 42 therein. The connector 32 also has means for electrically disconnecting the conductor 42 from the terminal 30 while retaining the conductor 42 in the passage 40. The connector 32 of this invention allows the customer's premises to be isolated and tested while the conductor 42 is retained in the connector 32. The passage 40 has an aperture 46 to an outer surface 48 of the body 38. The connector 32 includes an electrically conductive member 50. This electrically conductive member 50 has a first portion 52 and a second portion 54. The first portion 52 extends through the aperture 46 for crimping the conductor 42 in the passage 40. The second portion 54 is for electrically connecting to the terminal 30. The electrically conductive member 50 moves to disconnect the second portion 54 from the terminal 30 while still crimping the conductor 42 in the passage 40.

FIGS. 4–6 show the connector 32 and the electrically conductive member 50 are moveable between three (3) positions. FIG. 4 shows a first position for permitting electrical communication between the conductor 42 and the terminal 30. The first portion 52 of the electrically conductive member 50 extends through the aperture 46 and crimps the conductor 42 in the passage 40. The second portion 54 electrically connects to the terminal 30. FIG. 5 shows a second position for electrically disconnecting the connector 32 from the terminal 30 while retaining the conductor 42 secured to the connector 32. The second portion 54 is electrically disconnected from the terminal 30, yet the first portion 52 continues to crimp the conductor 42 in the passage 40. The customer's inside wiring is thus isolated from the network, however, the conductor 42 remains crimped in the connector 32. FIG. 6 shows a third position for electrically disconnecting the connector 42 from the terminal 30 and for releasing the conductor 42 from the connector 42. The second portion 54 is electrically disconnected from the terminal 30, and the conductor 42 is electrically disconnected from the first portion 52. The conductor 42 may thus be withdrawn from the passage 40.

Figure 7:
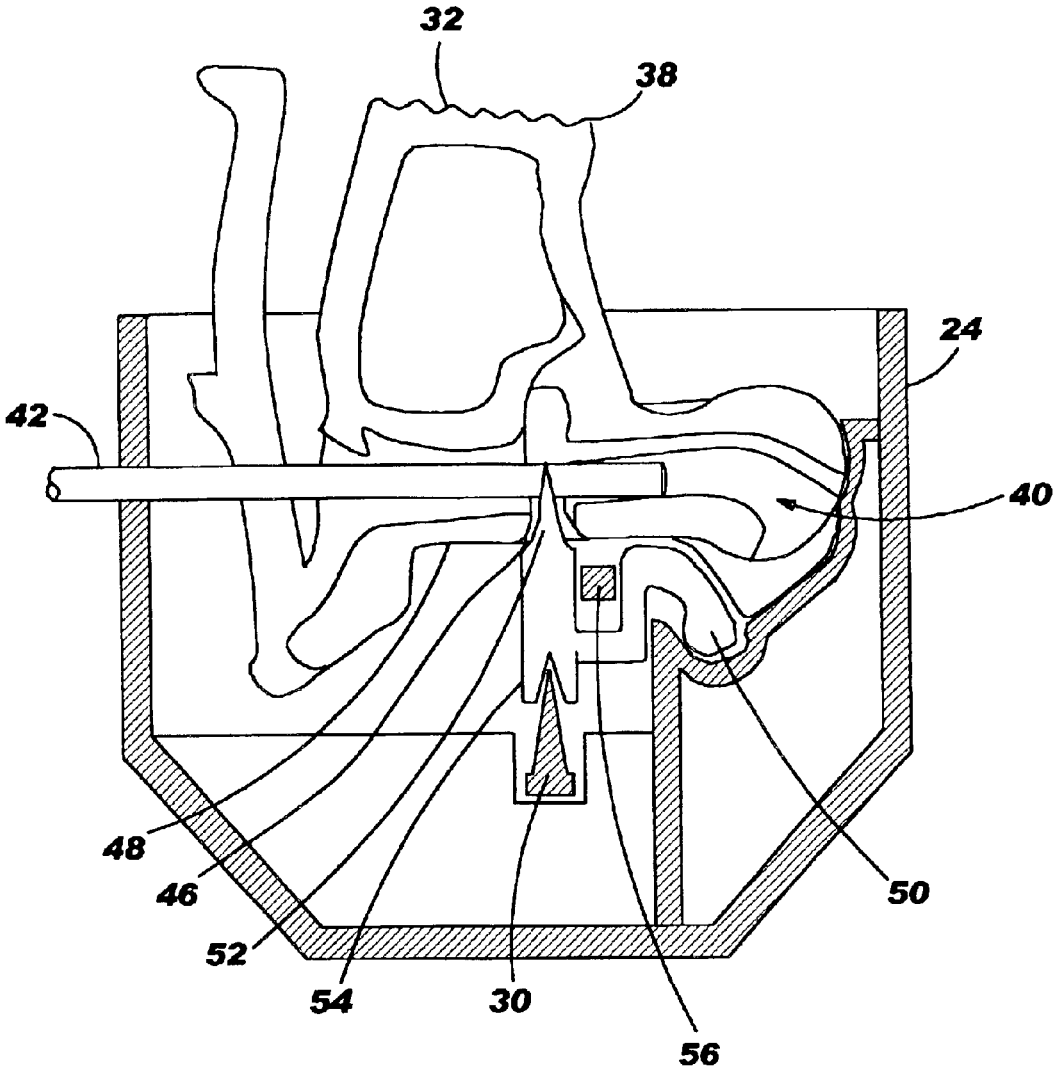
FIGS. 7–10 are schematics illustrating an alternative embodiment of this invention.
Figure 10:
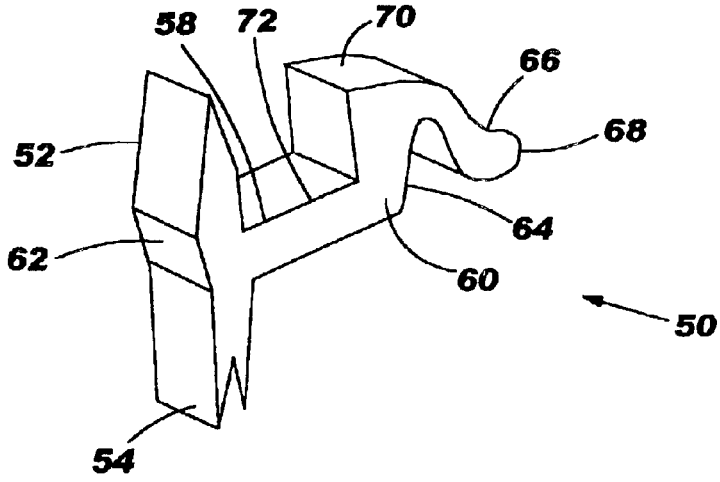
Figure 8:
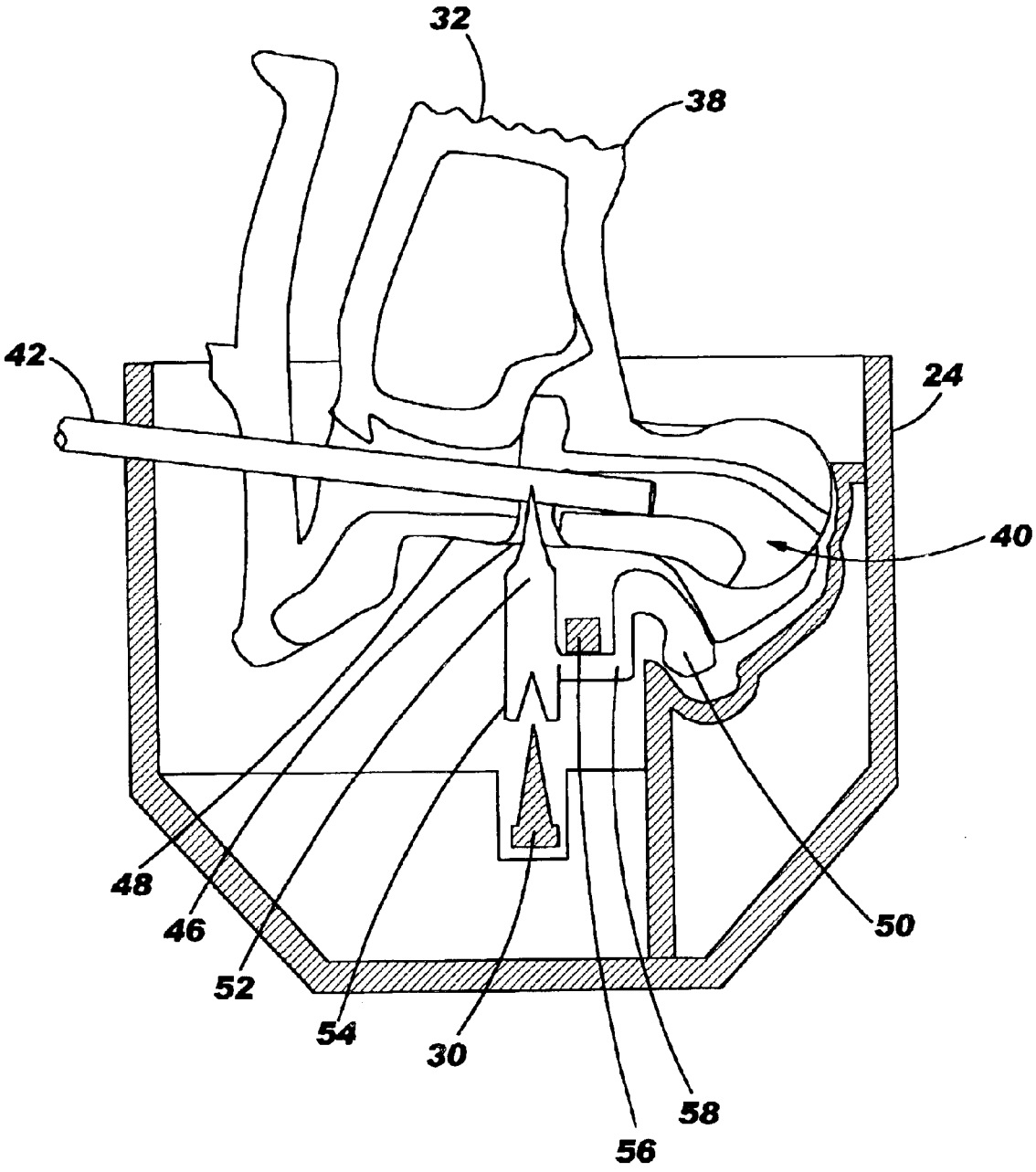
Figure 9:
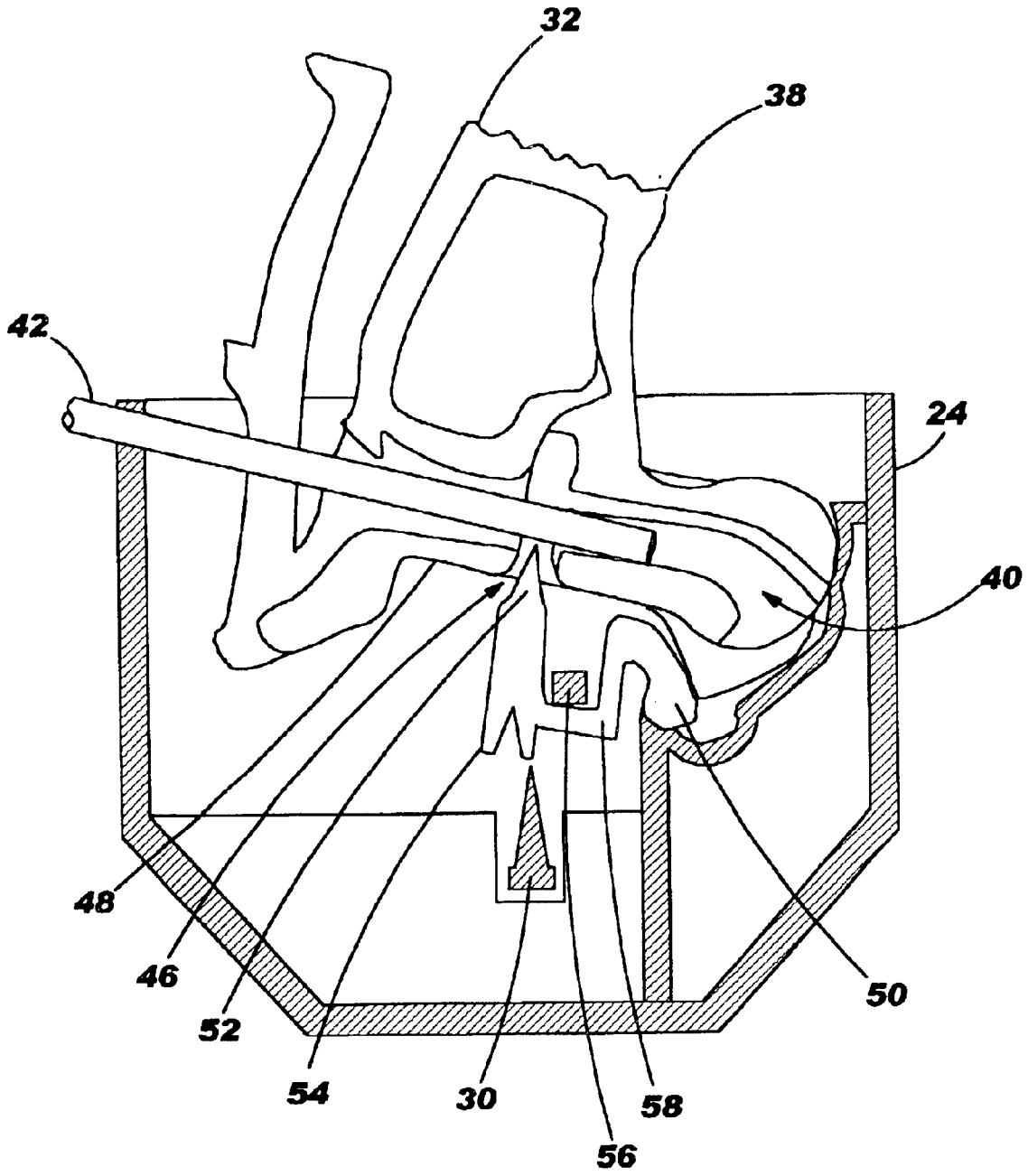

FIGS. 7–10 are schematics illustrating an alternative embodiment of this invention. FIGS. 7–9 are sectional views of the cover 24 taken along line $L_4$—$L_4$ (shown as reference numeral 44) of FIG. 2, while FIG. 10 is an isometric view of the electrically conductive member 50 shown in FIGS. 7–9. FIGS. 7–10 are enlarged for clarity. Here the means for disconnecting the conductor 42 from the terminal 30 comprises a stationary member 56. The stationary member 56 causes the connector 32 to release the conductor 42. The stationary member 56 is preferably a longitudinal rib or web in the cover 24. The stationary member 56 is disposed between the electrically conductive member 50 and the connector 32. FIG. 7 shows the first position that permits electrical communication between the conductor 42 and the terminal 30. The first portion 52 of the electrically conductive member 50 extends through the aperture 46 and crimps the conductor 42 in the passage 40. The second portion 54 electrically connects to the terminal 30. FIG. 8 shows the second position for electrically disconnecting the connector 32 from the terminal 30 while retaining the conductor 42 secured to the connector 32. The second portion 54 is electrically disconnected from the terminal 30, yet the first portion 52 continues to crimp the conductor 42 in the passage 40. A channel or depression 58 in the electrically conductive member 50 permits the electrically conductive member 50 to pivot without contacting the stationary member 56. Because the second portion 54 is electrically disconnected from the terminal 30, the customer's inside wiring (shown as reference numeral 20 in FIG. 1) is isolated from the network (shown as reference numeral 12 in FIG. 1). The conductor 42, however, remains crimped in the connector 32.

FIG. 9 shows the third position that electrically disconnects the connector 32 from the terminal 30 and that also releases the conductor 42 from the connector 42. The second portion 54 is electrically disconnected from the terminal 30, and the conductor 42 is electrically disconnected from the first portion 52. The channel or depression 58 in the electrically conductive member 50 contacts the stationary member 56 and stops the electrically conductive member 50 from moving between the second position (as illustrated in FIG. 8) and the third position. As the connector 32 pivots to the third position, the stationary member 56 prevents the electrically conductive member 50 from pivoting. Because the electrically conductive member 50 cannot pivot with the connector 32, the first portion 52 is pulled from contact with the conductor 42. The conductor 42 may thus be withdrawn from the passage 40.

FIG. 10 is an isometric view of the electrically conductive member 50 shown in FIGS. 7–9. The electrically conductive member 50 has a main body 60. The first portion 52 of the electrically conductive member 50 upwardly extends from the main body 60 at a first end 62. The second portion 54 of the electrically conductive member 50 downwardly extends from the main body 60 at the same first end 62. A second end 64 of the main body 60 includes a heel 66. The heel 66 has a curved surface 68 that seats against a surface in the cover. The electrically conductive member 50 pivots about the heel 66 when moving from the first position to the second position. The channel or depression 58 in the electrically conductive member 50 downwardly extends from a top 70 of the main body 60. The channel or depression 58 has a bottom 72 that contacts the stationary member (shown as reference numeral 56 in FIGS. 7–9) and stops the electrically conductive member 50 from moving between the second position and the third position.

The connector of this invention may also have other embodiments. The connector, for example, may have a plunger. This plunger acts against the electrically conductive member 50. When the technician depresses the plunger, the plunger pushes the electrically conductive member 50 and pushes the first portion 52 from contact with the conductor 42. The conductor 42 may thus be withdrawn from the passage 40. The plunger could slide within an interior passage of the connector 32 and bear against the electrically conductive member 50. The plunger, however, could also straddle the connector 32 and bear against the electrically conductive member 50.

The operation of this invention will now be described. As FIG. 2 illustrates, a technician or other person opens the cover 24 by moving or by pivoting the cover 24 about the hinge 26. As the cover 24 moves, one or more of the connectors 32 become accessible. The technician depresses the desired connector 32, as is well understood by those of ordinary skill in the art, thus slightly displacing the connector 32. Because the connector 32 is slightly displaced, the connector 32 is released from engagement with the cover 24 and upwardly pivots to reveal the passage 40. As FIG. 3 illustrates, the technician inserts the conductor 42 into and through the passage 40. Once the conductor 42 is situated in the passage 40, the technician again depresses the connector 32. As the connector 32 is depressed, the first portion 52 of the electrically conductive member 50 extends through the aperture 46 and crimps the conductor 42 in the passage 40. FIG. 4 illustrates that as the connector 32 is further depressed, the second portion 54 of the electrically conductive member 50 electrically connects to the terminal 30.

FIGS. 5 & 6 illustrate the two-stage operation of isolating the terminal 30 from the conductor 32. FIG. 5 illustrates the second position of the connector 32, in which the connector 32 is electrically disconnected from the terminal 30. Even though the connector 32 is electrically disconnected, the conductor 42 is still secured to the connector 32. The second portion 54 is electrically disconnected from the terminal 30, yet the first portion 52 continues to crimp the conductor 42 in the passage 40. The customer's inside wiring is thus isolated from the network, however, the conductor 42 remains crimped in the connector 32. A technician may test the customer's inside wiring without having to remove the conductor 42, strip the conductor 42, and then re-insert the conductor 42 after the test. FIG. 6 illustrates the third position of the connector 32, in which the connector 32 is electrically disconnected from the terminal 30. Here, however, the connector 42 also releases the conductor 42. The second portion 54 is electrically disconnected from the terminal 30, and the conductor 42 is electrically disconnected from the first portion 52. The technician may thus withdraw the conductor 42 from the passage 40.

FIGS. 7–9 illustrate the two-stage operation of the alternative embodiment of this invention. The technician, as discussed in paragraph [0019], opens the cover 24 and depresses the desired connector 32. The connector 32 releases from engagement with the cover 24 and upwardly pivots to reveal the passage 40. The technician inserts the conductor 42 into and through the passage 40 and depresses the connector 32. The first portion 52 of the electrically conductive member 50 extends through the aperture 46 and crimps the conductor 42 in the passage 40. As the connector 32 is further depressed, the second portion 54 electrically connects to the terminal 30. FIG. 7 thus illustrates the first position of the connector 32 that permits electrical communication between the conductor 42 and the terminal 30. The first portion 52 of the electrically conductive member 50 extends through the aperture 46 and crimps the conductor 42 in the passage 40. The second portion 54 electrically connects to the terminal 30. FIG. 8 shows the second position that electrically disconnects the connector 32 from the terminal 30. The second portion 54 is electrically disconnected from the terminal 30, yet the first portion 52 continues to crimp the conductor 42 in the passage 40. The channel or depression 58 in the electrically conductive member 50 permits the electrically conductive member 50 to pivot without contacting the stationary member 56. Because the second portion 54 is electrically disconnected from the terminal 30, the customer's inside wiring is isolated from the network. The conductor 42, however, remains crimped in the connector 32. FIG. 9 illustrates the third position that electrically disconnects the connector 42 from the terminal 30 and that also releases the conductor 42 from the connector 42. The channel or depression 58 in the electrically conductive member 50 contacts the stationary member 56 and stops the electrically conductive member 50 from moving. As the connector 32 pivots to the third position, the stationary member 56 prevents the electrically conductive member 50 from pivoting. Because the electrically conductive member 50 cannot pivot with the connector 32, the first portion 52 is pulled from contact with the conductor 42. The conductor 42 may thus be withdrawn from the passage 40.

While the present invention has been described with respect to various features, aspects, and embodiments, those skilled and unskilled in the art will recognize the invention is not so limited. Other variations, modifications, and alternative embodiments may be made without departing from the spirit and scope of the present invention.

What is claimed is:

1. An apparatus, comprising:

a connector for electrically connecting a conductor to a terminal, the connector having a body and a passage for positioning the conductor therein, the passage having an aperture to an outer surface of the body; and the connector also having an electrically conductive member having a first portion and a second portion, the first portion extending through the aperture for crimping the conductor in the passage, the second portion for electrically connecting to the terminal, the electrically conductive member moving to disconnect the second portion from the terminal while still crimping the conductor in the passage.

2. An apparatus, comprising:

a network interface module for a Network Interface Device, the network interface module providing a demarcation between a customer's premises and a conductor of a network, the network interface module comprising a base, a cover for the base, and a terminal electrically connectable to a connector; and the connector comprising means for electrically disconnecting the conductor from the terminal while crimping the conductor in the connector, wherein the customer's premises can be isolated and tested while the conductor is crimped in the connector.

3. An apparatus according to claim 2, wherein the means for disconnecting the conductor from the terminal comprises a stationary member, the stationary member causing the connector to release the conductor.

4. An apparatus according to claim 2, wherein the means for disconnecting the conductor from the terminal comprises a stationary member disposed between the connector and an electrically conductive member, the stationary member contacting the electrically conductive member.

5. An apparatus according to claim 2, wherein the network interface module further comprises a modular jack connectable to the terminal.

6. An apparatus, comprising:

a network interface module for a Network Interface Device, the network interface module connecting a conductor between a customer's premises and a network, the network interface module comprising a base, a cover for the base, and a terminal electrically connectable to a connector, the connector having a first position for permitting electrical communication between the conductor and the terminal;

the connector having a second position for electrically disconnecting the connector from the terminal while crimping the conductor in the connector; and the connector having a third position for electrically disconnecting the connector from the terminal and for releasing the conductor from the connector, wherein the connector allows the customer's premises to be isolated and tested while still crimping the conductor in the connector.

7. An apparatus according to claim 6, wherein the network interface module further comprises a modular jack connectable to the terminal.

8. An apparatus according to claim 6, wherein the connector comprises a body and an electrically conductive member;

the body having a passage for positioning the conductor therein, the passage having an aperture to an outer surface of the body;

the electrically conductive member having a first portion and a second portion, the first portion extending through the aperture for crimping the conductor in the passage, the second portion for electrically connecting to the terminal, the electrically conductive member moving to disconnect the second portion from the terminal while still crimping the conductor in the passage.

9. An apparatus according to claim 6, wherein the connector comprises a body and an electrically conductive member, and a stationary member stops the electrically conductive member from moving between the second position and the third position.

10. An apparatus according to claim 9, wherein the stationary member comprises a rib in the cover.

11. An apparatus according to claim 9, wherein the electrically conductive member contacts the stationary member to release the conductor from the connector.

12. An apparatus according to claim 9, wherein the electrically conductive member comprises a channel that contacts the stationary member to release the conductor from the connector.

* * * * *